US006702617B1

(12) United States Patent
Clement et al.

(10) Patent No.: US 6,702,617 B1
(45) Date of Patent: Mar. 9, 2004

(54) ELECTRICAL CONNECTOR WITH GEOMETRICAL CONTINUITY FOR TRANSMITTING VERY HIGH FREQUENCY DATA SIGNALS

(75) Inventors: Jean-Yves Clement, Saint Jeannet (FR); Franck Subias, Mandelieu (FR)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/453,950

(22) Filed: Jun. 4, 2003

(30) Foreign Application Priority Data

Aug. 22, 2002 (EP) ..... 02368091

(51) Int. Cl.[7] ..... H01R 13/648
(52) U.S. Cl. ..... 439/608; 439/607
(58) Field of Search ..... 439/607, 608, 439/609, 610

(56) References Cited

U.S. PATENT DOCUMENTS 4,990,094 A * 2/1991 Chandler et al. ..... 439/108
5,906,511 A * 5/1999 Bozzer et al. ..... 439/579
6,077,122 A * 6/2000 Elkhatib et al. ..... 439/608
6,296,523 B1 * 10/2001 Sasai ..... 439/660
6,328,601 B1 * 12/2001 Yip et al. ..... 439/608
6,506,077 B2 * 1/2003 Nagel ..... 439/608
6,629,858 B2 * 10/2003 Lo et al. ..... 439/607

* cited by examiner

*Primary Examiner*—Michael C. Zarroli
(74) *Attorney, Agent, or Firm*—David R. Irvin

(57) ABSTRACT

A connector for cables containing at least one twisted pair for transmission of very high frequency signals. The conductors of the pair are connected in a connection block by insulation displacement contacts to contact blades, adapted to ensure contact in an interface block with the corresponding contact blades of the other connector. When connection is made, the geometry of the elements of the connection block is the same as the geometry of the elements of the interface block. This geometry is adapted so that the differential mode impedance between the conductors of each pair and the common mode impedance between the conductors and the shielding of the pair are respectively equal to the differential mode impedance between the contact blades and the common mode impedance between the contact blades and the shielding of the connector.

15 Claims, 8 Drawing Sheets

ELECTRICAL CONNECTOR WITH GEOMETRICAL CONTINUITY FOR TRANSMITTING VERY HIGH FREQUENCY DATA SIGNALS

TECHNICAL FIELD

The present invention relates generally to electrical shielded connectors terminating a cable assembly of twisted and shielded pairs of conductors, and relates more particularly to an electrical connector without geometrical discontinuity for transmitting very high frequency data signals.

BACKGROUND

In data transmission networks there are several problems when data is transmitted at high frequency over a plurality of circuits over multi-pair shielded data communication cable. In particular, at high transmission rates, one of the problems is that each wiring circuit itself both transmits and receives electromagnetic signals so that the signals flowing through one circuit or wire pair may couple with the signals flowing through another circuit or wire pair. The unintended electromagnetic coupling of signals between different pairs of conductors of different electrical circuits is called cross-talk, and is a source of interference that often adversely affects the processing of these signals.

Another problem is that the connecting hardware may introduce a geometrical discontinuity in the transmission line geometry of the cabling system. The geometrical parameters of a multi-pair shielded data communication cable such as conductor diameter, insulation thickness, or shield structure, in turn determine the electrical transmission parameters such as impedance, return loss, velocity factor, and so forth.

Today, connectors are designed to provide good electrical performance up to frequencies of about 600 MHz, to be practical to implement on-site, and to maintain continuity between the connector housing and the cable shield. In this vein, U.S. Pat. No. 6,077,122 relates to an electrical connector including an electrically conductive strain relief device that comprises mirrored strain relief members which are in electrical communication with the shield housing and the cable ground path between the cable ground and the contact shield housing. However, the geometry of the connecting system is entirely different from the cable geometry since, in the connecting system, the conductors of the pairs included in the cable are aligned in a plane. Such a geometrical discontinuity generates a discontinuity in the transmission parameters, which results in undesired reflections that modify the attenuation and the return loss of the connector as the frequency approaches 1,200 MHz.

SUMMARY

Accordingly, an object of the invention is to provide an electrical connector that preserves the geometrical continuity of the transmission line in order to transmit data signals with frequencies significantly higher than 600 MHz, for example 1,200 MHz.

The invention relates therefore to a connector designed to be interconnected to another connector of the same type to connect two cables. Each cable contains at least one twisted pair for the transmission of very high-frequency differential data signals, in which the conductors of the pair are connected in a connection block by means of Insulation Displacement Contacts (IDC) to contact blades, adapted to ensure contact in an interface block with the corresponding contact blades of the other connector. When the connection is made, the geometry of the elements comprising the connection block is the same as the geometry of the elements comprising the interface block, the geometry being adapted so that the differential mode impedance between the conductors of each pair and the common mode impedance between the conductors and the shielding of the pair are respectively equal to the differential mode impedance between the contact blades and the common mode impedance between the contact blades and the shielding of the connector.

BRIEF DESCRIPTION OF THE DRAWINGS

The above and other objects, features and advantages of the invention will be better understood by reading the following more detailed description of the invention in conjunction with the accompanying drawings wherein.

DETAILED DESCRIPTION

Figure 1:
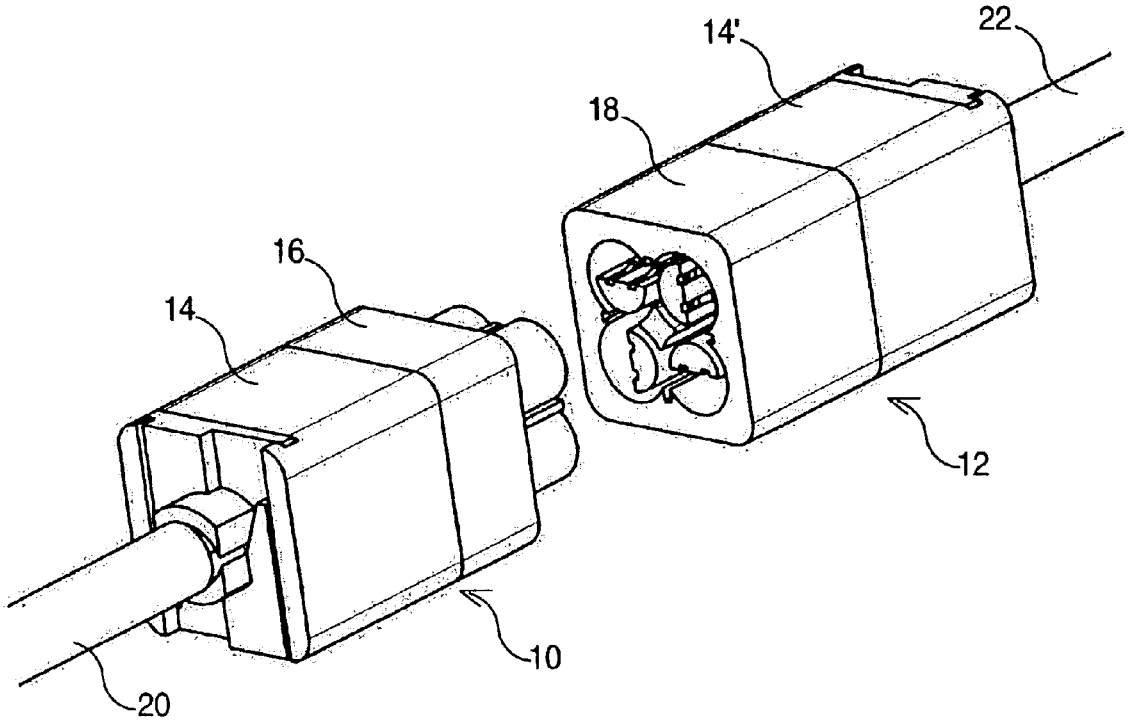
FIG. 1 is a perspective view showing a male connector and a female connector before their connection together.

A connector according to the present invention is designed to interconnect with another connector of the same type, but of the opposite gender. In this manner, as shown in FIG. 1, the male connector 10 is adapted to connect with the female connector 12. This type of connector is said to be "semi-hermaphroditic" insofar as, while the connectors are different in their external appearance, they feature hermaphroditic contacts, as will be described below.

As opposed to hermaphroditic connectors, semi-hermaphroditic connectors enable manufacturing costs to be lowered. Semi-hermaphroditic connectors require fewer different parts, and consequently fewer different kinds of molds and cutting tools. Moreover, semi-hermaphroditic connectors do not present the drawbacks of hermaphroditic connectors, which require precise maintenance of tolerances in order to ensure perfect interconnection between both connectors. In the case of hermaphroditic connectors, modifying a dimension of one of the two connectors gives rise to the same modification on the other connector. As a connector includes various elements, managing an interface dimension tolerance change becomes very difficult, especially in the case of multiple production sources.

On the other hand, when a semi-hermaphroditic configuration is used, as in the case of the invention, the production of golden females, for example, allows different families of male connectors to be produced in different manufacturing locations without influencing the fabrication of the female connectors, and vice versa. Among other considerations, the relative alignment of the common parts, such as the contact supports, is possible by adjusting their position inside the connector body.

Each connector has a metallic body made up of a connection block 14 or 14' used to connect the cable to the connector, and which is identical for each male or female connector, and an interface block 16 or 18 which is different depending on whether the connector is male or female. Both connection and interface blocks may be merged into a single part. In this case, only two different molds, instead of three, are required to manufacture both connectors.

Although the cables 20 and 22, interconnected by connectors 10 and 12 according to the invention, are multiple-pair cables capable of including any number of pairs, the cables used in the illustrative embodiment described here feature four pairs. In this manner, each connector, whether it is male or female, includes four cylindrically shaped cavities as shown in FIG. 1, in which are located the hermaphroditic contacts designed to ensure the electrical connection between each pair of the male connector and each pair of the female connector.

Figure 2:
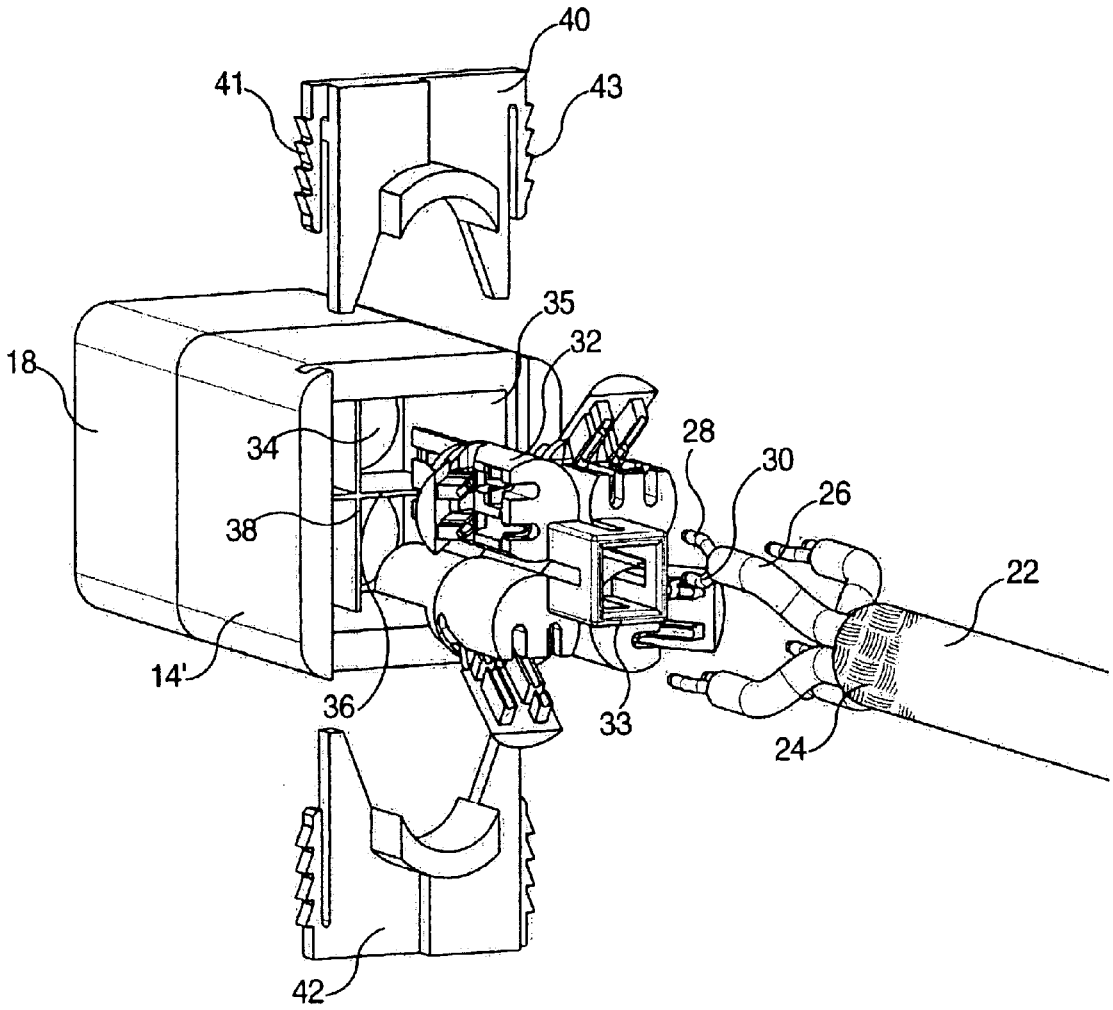
FIG. 2 is a perspective and partially exploded view representing the female connector, the dressing-blocks, and the cable before the insertion of the conductors of each pair into the IDC.

As shown in FIG. 2, each cable 20 or 22 is first stripped by removing an end part of the outer jacket and the shielding braid 24 so as to separate the four pairs which are wound together to form a strand. This shielding ensures that the cable is isolated from external electromagnetic disturbances and maintains pairs against one another. The conductors 28 and 30 of each pair 26 are insulated by a sheath made of plastic material, and twisted together to form the transmission line. The electrical characteristics of the transmission line are defined by geometric parameters such as the diameter of the conductors, the diameters of the insulating materials, and the twist pitch. In order to meet high performance criteria, particularly in terms of isolation, each pair is individually shielded. The two conductors 28 and 30 of the pair are then connected to the connector's contacts by a dressing-block 32.

It should be noted that the four dressing-blocks 32 may be molded in one single piece, two parts, or four separate parts. In the exemplary embodiment described with reference to FIG. 2, they are single pieces held together by an optional support 33.

The connection block 14' (as all the connection blocks) features four cylindrical cavities 34 designed to receive the dressing-blocks 32, and a cavity 35 in front of the connection block designed to house the four pairs of conductors, still wrapped in their individual shielding. This cavity 35 is divided in half along its depth into four insulation sub-cavities by two orthogonal conducting walls 36 and 38. These walls ensure the transition of the shielding between the part of the cable where the individual shielding of the pairs is in contact against one another (a location where the pairs are well insulated by their insulating sheaths) and the part where the pairs are separated and where the individual shielding stops. The rear of the connection block is closed by two diaphragm-type guillotines 40 and 42, which will be described below, ensuring both electrical continuity (ground connection) and a seal against external contaminants by exerting pressure on the cable shielding.

Figure 3:
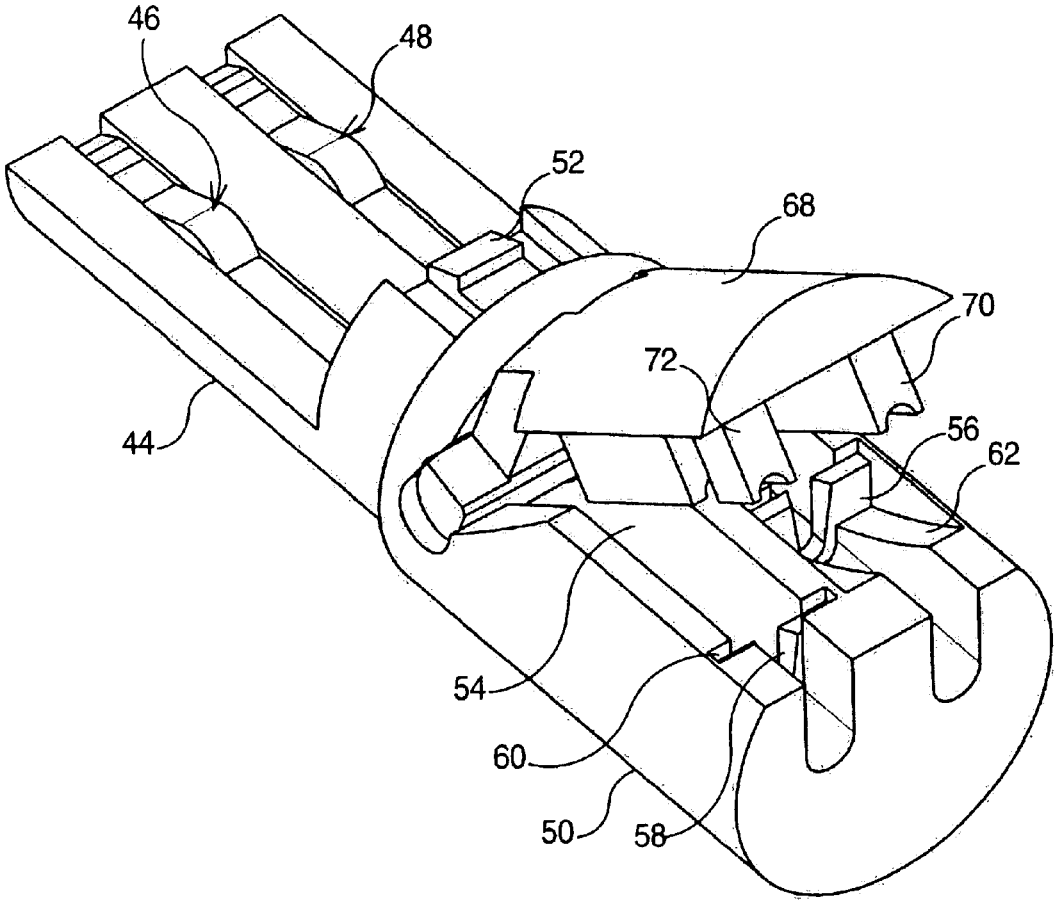
FIG. 3 is a perspective view of a dressing-block in which the closing lever has been raised before the insertion of the conductors of the pair.

Each dressing-block 32, as illustrated in FIG. 3, has a front part 44 made of plastic which supports the two contact blades 46 and 48 designed to ensure the connection with the other connector of opposite gender, and a rear part 50 also made of plastic used to connect the two conductors of the pair by traditional IDC (Insulation Displacement Contact). When the connection is complete for the four dressing-blocks, the assembly is fully inserted into the connection block of the connector until the catches 52 for each dressing-block lock the assembly in the connector. In this position, the front parts 44 of the dressing-blocks are located inside the connector's interface block, and the rear parts 50 are located in the cylindrical cavities 34 of the connection block (see FIG. 2). It should be noted that the cylindrical cavity 34, which extends to the end of the interface block, features the same geometric characteristics over the entire length of the connector so as to maintain the same electrical characteristics.

Figure 4A:
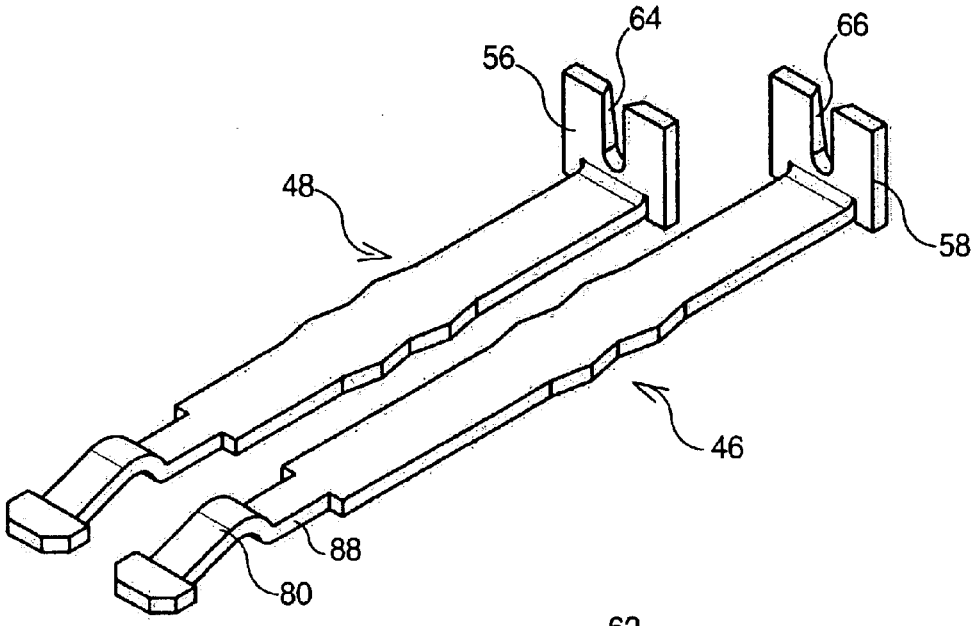
FIGS. 4A and 4B represent a perspective view of the contact blades and the dressing-block without its closing lever before the insertion of the blades into the dressing-block.
Figure 4B:
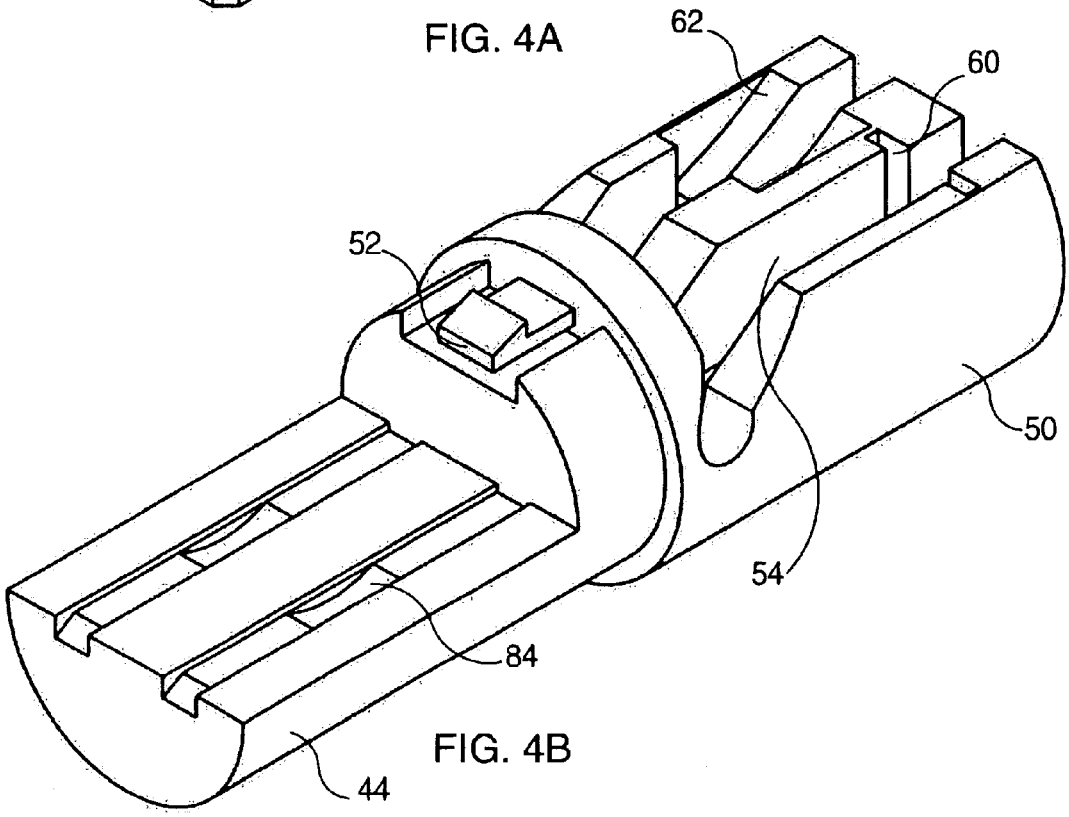

The rear part 50 of each dressing-block has two slides 54 into which the two contact blades 46 and 48 are introduced. As shown in FIGS. 4A and 4B representing the dressing-block and the contact blades which have not yet been inserted into the dressing-block, contact blade 48 is shorter than contact blade 46. This is important insofar as the IDCs 56 and 58 have lengths selected to prevent them from being placed side by side in order to prevent them from coming into contact, which could happen if both blades were the same length. In the latter case, in order to prevent contact, a space would be required between the contact blades which would be excessive in this case, in order to preserve the electrical parameters of the line.

When a connection is made, each IDC is introduced into its respective slide, such as the slide 60 for the IDC 58 visible in FIG. 4B (the slide in which the IDC 56 is inserted is not visible in the figure). It should be noted that the dressing-block has a chamfer 62 at the front of the slide intended to receive the IDC 56, the purpose of which is to introduce the contact blade 48 without permanently distorting it.

In order to ensure that each conductor of a pair is connected, the conductors are introduced into the slides 54 whose lengths are calculated so that the vertical cutting sides 64 or 66 make solid contact with the insulation of each conductor. The pair is introduced into the dressing-block so that its shielding 26 (see FIG. 2) comes into contact with the rear of the dressing-block body, which ensures the continuity of the shielding with the cylindrical cavity 34. It should be noted that the IDCs form an integral part of the contact blades in the exemplary embodiment described here.

The dressing-block features a closing lever 68, rotating around a pin, which is lowered when the pair is introduced into the dressing-block. When lowered, the lever 68 forces the conductors to enter the IDCs 56 and 58. The IDCs slit the insulation owing to their sharp vertical sides 64 and 66 and penetrate into the conductor's copper, thus ensuring a durable electrical contact. This easy and quick procedure is especially helpful when operations must be performed at sites where local networks are being installed. The lever closing operation is repeated on the four dressing-blocks before the assembly is inserted into the connector as described previously. It should be noted that the closing lever features retaining elements such as elements 70 and 72, the lower portion of which has a semicircular profile in order to exert a retaining force on the conductors in the slides 54 when the closing lever has been pressed downward.

The connector described above is designed to comply with the transmission characteristics of a pair-shielded cable as closely as possible. As such, it features cylindrical cavities 34 (see FIG. 2) and extension 74 (see FIG. 5A) so as to maintain a more constant distance between the conductors and the ground of the connector's ground. This geometry improves the linearity of the differential mode impedance between the two conductors as well as the impedance between the conductors and the shielding of the connector (common mode impedance), which is not the case when there are sharp angles and planes at 90° which require the high frequency return currents to change directions in the conductor body of the connector.

The continuity between the circular geometry of the connection block and the circular geometry of the interface block has particular importance. This continuity reduces the interface's return loss and thus reduces the attenuation, which has become a crucial parameter of current industry standards (category 8 of the ISO standards) applied to transmission frequencies above 600 Mhz and which may exceed 1.2 Ghz.

Figure 5A:
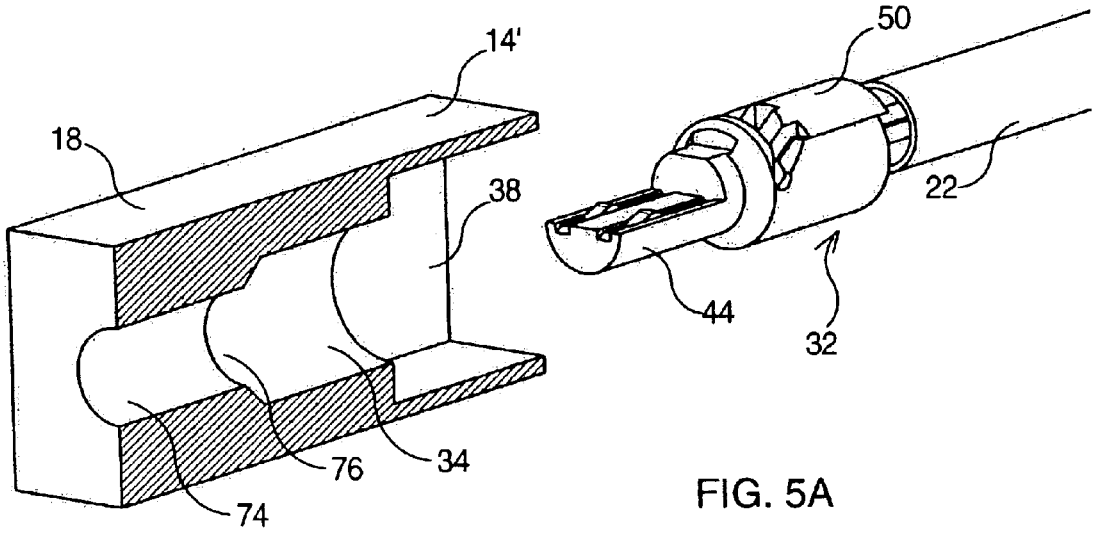
FIGS. 5A and 5B illustrate a longitudinal section of the connector cavity showing the inside cavities and the dressing-block connected to the cable before the insertion of the dressing-block into the connector and after the insertion.
Figure 5B:
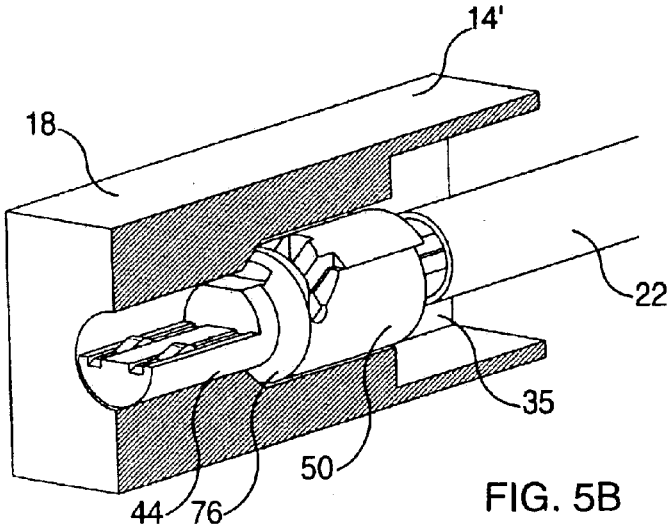

The description now refers to FIGS. 5A and 5B which represent the longitudinal section of the connector showing the cavities into which the dressing-block and contact blade assembly is integrated, both before and after the insertion of this assembly into the connector. The cylindrical cavity into which the dressing-block 32 is inserted is terminated by a first cylindrical cavity having a circular section of small diameter 74 in which the front part 44 of the dressing-block is incorporated and which is located in the interface block, and by a second cylindrical cavity with a circular section of larger diameter 34 in the same axis as the first cavity. This portion of larger diameter 34 is located inside the connection block and is designed to receive the rear portion 50 of the dressing-block. Both cavities 34 and 74, while having different diameters in the exemplary embodiment described here, may also have the same diameter. The salient points are that their geometry should be the same (concentric cylindrical shapes) and that they should have the same proportions as the conductors. In addition, the transition zone 76, which has the shape of a truncated cone in this embodiment, should not have sharp angles so that it does not disturb the return currents circulating in the body of the connector, which would generate parasitic reflections.

In order to ensure the best possible geometric continuity, the cable 22 should be mounted in the connection block so that the shielding of each pair of conductors 26 ends up in the second cylindrical cavity 34 where the connection takes place. In this manner, as regards the transmission, the environment that the pair will encounter in the cavity 35 (where the wall 38 is located) which is not cylindrical will have no influence on the electrical parameters. For this reason, the walls 36 and 38 of the cavity 35 (see FIG. 2) are not involved in the transmission parameters, although they are designed to isolate the pairs from one another in order to reduce diaphony between pairs.

The geometric continuity of the connector described above is designed to obtain an important characteristic of the invention, according to which the differential mode impedance of the twisted pair derived from the cable is equal to the differential mode impedance of the connector, particularly in the area of the contact blades.

The differential mode impedance of a twisted pair is equal to:

$$Z_{pd} = \frac{120}{\sqrt{\varepsilon r}} \mathrm{Ln}\left(X \cdot \frac{b^2 - s^2}{b^2 + s^2}\right)$$

where Ln stands for neperian logarithm and $\epsilon r$ is the relative permittivity, b is the inside diameter of the shield (shielding), s is the distance between the centers of the conductors, and X=2s/d, where d is the diameter of the conductors. The value of the impedance is thus determined by the cable. The dimensional parameters of the connector after the IDC are adapted so that the value of the differential mode impedance of this part of the connector is the same. This is an advantage of the present invention, which provides geometric continuity, whereas connectors according to the prior art do not provide the advantageous geometric continuity.

The same is true concerning the common mode impedance of the twisted pair which is equal to the common mode impedance of the connector, particularly in the area of the contact blades. For the twisted pair, this impedance is equal to:

$$Z_{pc} = \frac{60}{\sqrt{\varepsilon r}} \mathrm{Ln} A \cdot \frac{b}{d}$$

where Ln again stands for neperian logarithm and A is an experimental coefficient having a value between 1 and 2.

Figure 6:
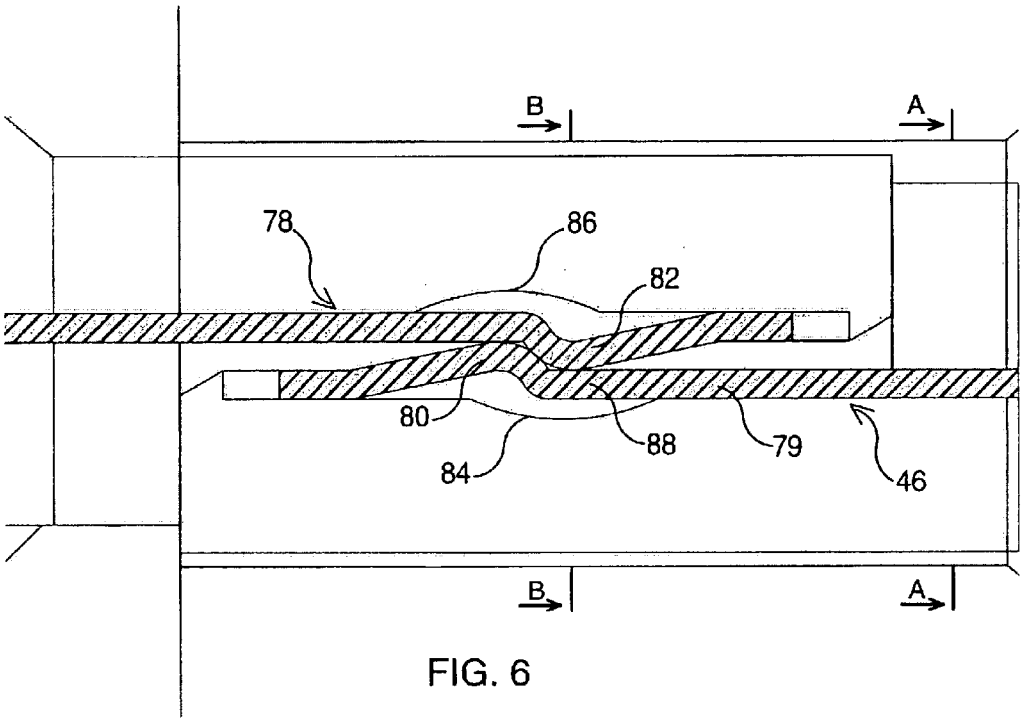
FIG. 6 shows a longitudinal section of the contact blades of the male and female connectors in contact with each other after the two connectors have been connected together.

With reference to FIG. 6, the contact between a male connector and a female connector is ensured by a contact blade 46 in the first connector and a contact blade 78 in the second connector. These blades are identical in shape as mentioned previously. In each connector, the contact blade is connected to the sharp part of the IDC, for example the sharp part 66 of the IDC 58 for the contact blade 46. It is placed in a groove of the front part 44 of the dressing-block (see FIG. 4B) and has teeth to hold it in place in the groove (see FIG. 4*a*).

Each contact blade, such as blade 46, after a rectilinear portion 79, has a stiff side terminated by a rounded bump 80 for the blade 46 or 82 for the blade 78 and a slightly inclined plane terminating at the end of the blade. When the interface block of the male connector is inserted into the interface block of the female connector, the two slightly inclined planes come into contact while exerting a slight resistance. The blades deform while forcing the rounded bumps into a recess 84 or 86 provided for this purpose at the base of the groove where the blade is located. Once the rounded bump of each blade has passed to the other side of the rounded bump of the other blade, the two blades return nearly to their initial shape and are in auto-latching contact with one another on their stiff sides. This mechanism has the advantage of enabling each pair of contacts to be retained individually without requiring an external locking mechanism. This way, a connector provided with only one or two pairs instead of four can be manufactured. In addition, in case the plug is accidentally pulled out, the connectors are unlocked without damage, as opposed to the use of an external locking mechanism which leads to the destruction of both the jack and the wall support.

Once again with reference to FIG. 4A, it can be seen that the contact blade 46 is wider along its rectilinear part 79 than at its end where the contact is made, which comprises a rectilinear part 88, the stiff side, the rounded bump 80 (location of the actual contact), and the inclined plane. This is needed to obtain electrical continuity as explained below.

Figure 7A:
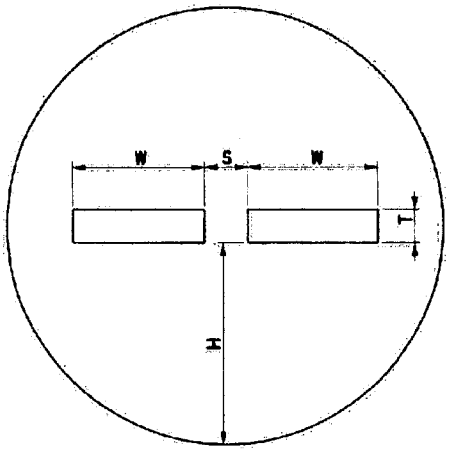
FIGS. 7A and 7B illustrate respectively a cross-section of the connector showing the rectilinear part of the blades and a cross-section of the connector showing the contact between the contact blades of the two connectors.
Figure 7B:
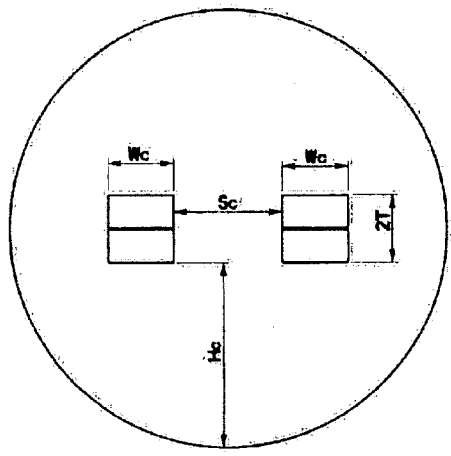

Reference is now made to FIGS. 7A and 7B, which represent cross-section A of the connector showing the single blade 46 in the rectilinear part (see FIG. 6) and cross-section B of the interconnection at the point of contact between the rectilinear part of the blade 46 and the bump 82 of the blade 78 of the other connector, respectively. As shown, the thickness T of each blade remains constant, and its width shifts from W in its rectilinear part to Wc at the contact point.

When taking into consideration the approximations justified by the geometric characteristics commonly used in this technology, the common mode impedance of the contact blades in relation to the shielding cavities is given by the following $$Z_{cc} = \frac{60}{\sqrt{\varepsilon r}} \mathrm{Ln}\left(\frac{1.9B}{0.8W + T}\right)$$

where Ln stands for neperian logarithm, B=2H+T is the distance between the reference ground planes, that is to say between the opposite walls in the cavity.

As seen previously, the values of the dimensional parameters W and T are selected so that this common mode impedance of the contact blades is equal to the common mode impedance of the twisted pair, that is:

$$Z_{cc}=Z_{pc}$$

It should be noted that the differential mode impedance of the contact blades between themselves, which is equal to the differential mode impedance of the twisted pair, is given by:

$$Z_{cd} = 2Z_{cc}\left(1 - 0.347e^{-2.9\frac{S}{B}}\right)$$

At the contact point illustrated by FIG. 7B, where the thickness becomes 2T, a different width Wc is required to maintain a constant common mode impedance. To do this, the following equation must be true:

$$0.8Wc+2T=0.8W+T,$$

which may be simplified as:

$$Wc=W-1.25T$$

The differential mode impedance of the contact blades remains essentially constant, as the only parameter that varies is $$1 - 0.347e^{-2.9\frac{S}{B}}$$

although this variation is very low due to the fact that S is replaced by Sc.

The closure of the cable side connector is ensured by two guillotines 40 and 42 as mentioned above (see FIG. 2). These two guillotines slide in two side grooves made in the connector body, and may be pre-positioned in their respective housings during manufacture without disrupting the assembly of the connector with the cable. Once the assembly operation is completed, the two guillotines are pressed together using a pair of parallel pliers to close them onto the shielding braid 24 of the cable 22. It is thus important that the guillotines, which are made of conductive material, be in electrical contact with the cable shielding so as to ensure the continuity of the shielding. In order to do this, the braid 24 can be folded back onto the outer jacket of the cable or a sufficient length of the outer jacket may be removed from the cable so that the guillotines can press on the braid and the film of the four pairs.

Figure 8A:
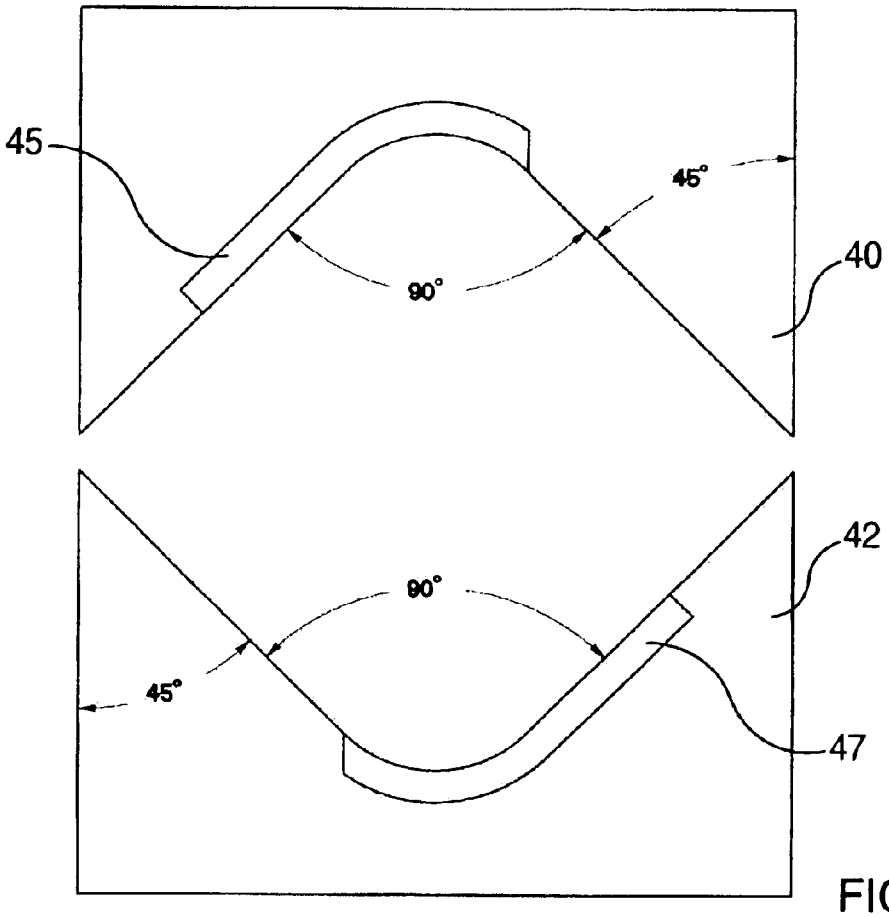
FIGS. 8A and 8B illustrate respectively two positions of the guillotine mechanism in a first embodiment for the clamping of the cable.

When clamped using pliers, the guillotines 40 and 42 initially have the positions shown in FIG. 8A. As the clamping operation goes ahead, the guillotines are retained by racks located on the sides of the guillotines, such as racks 41 and 43 of the guillotine 40 visible in FIG. 2. When clamping is complete, the guillotines are in the position shown in FIG. 8B. It should be noted that the racks ensure that the cable is adequately held at all times, regardless of its diameter.

The guillotine mechanism is an important characteristic of the invention. Indeed, problems common to all systems designed to retain a cable in a connector are to ensure a proper grip, to ensure a good 360° seal, and to ensure that the cable is not deformed or shorted internally. Mechanisms used in the prior art generally feature a fixed geometry, and thus encounter a dilemma of correctly maintaining the cable while crushing it, or not deforming the cable at the expense of a poor seal, poor electrical contact, and poor recovery of the stresses endured by the cable. The present invention solves these problems by providing the guillotines with side edges forming a 90° angle between them and a 45° angle in relation to the direction of guillotine movement during the clamping operation. When the guillotines come together to shift from the position illustrated in FIG. 8A to the position illustrated in FIG. 8B, the cable entry hole reduces both vertically and horizontally and the two side edges form a diaphragm as they approach. In this manner, the cable is clamped uniformly on four sides, which prevents it from being crushed.

Figure 8B:
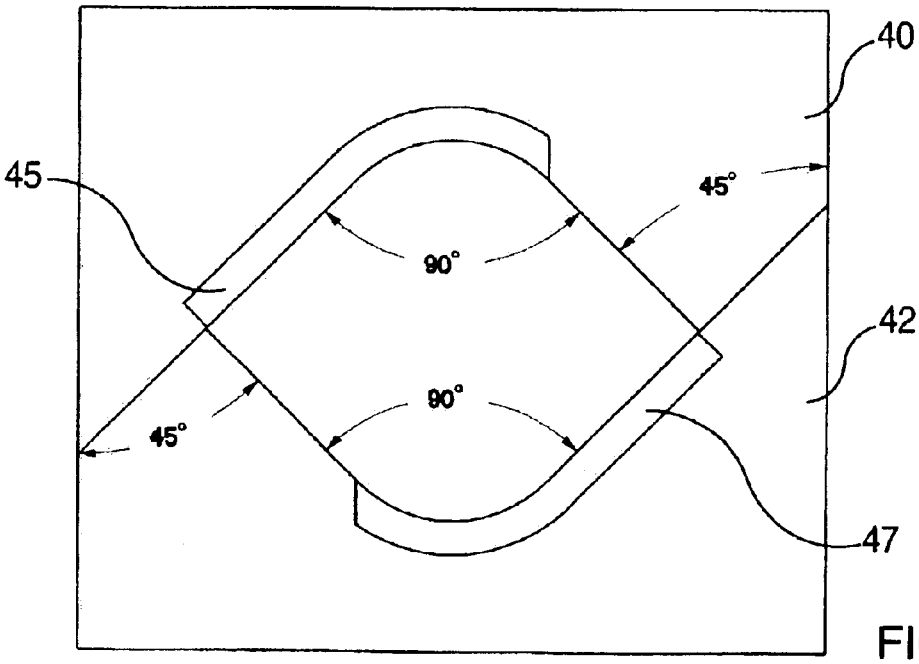
Figure 9:
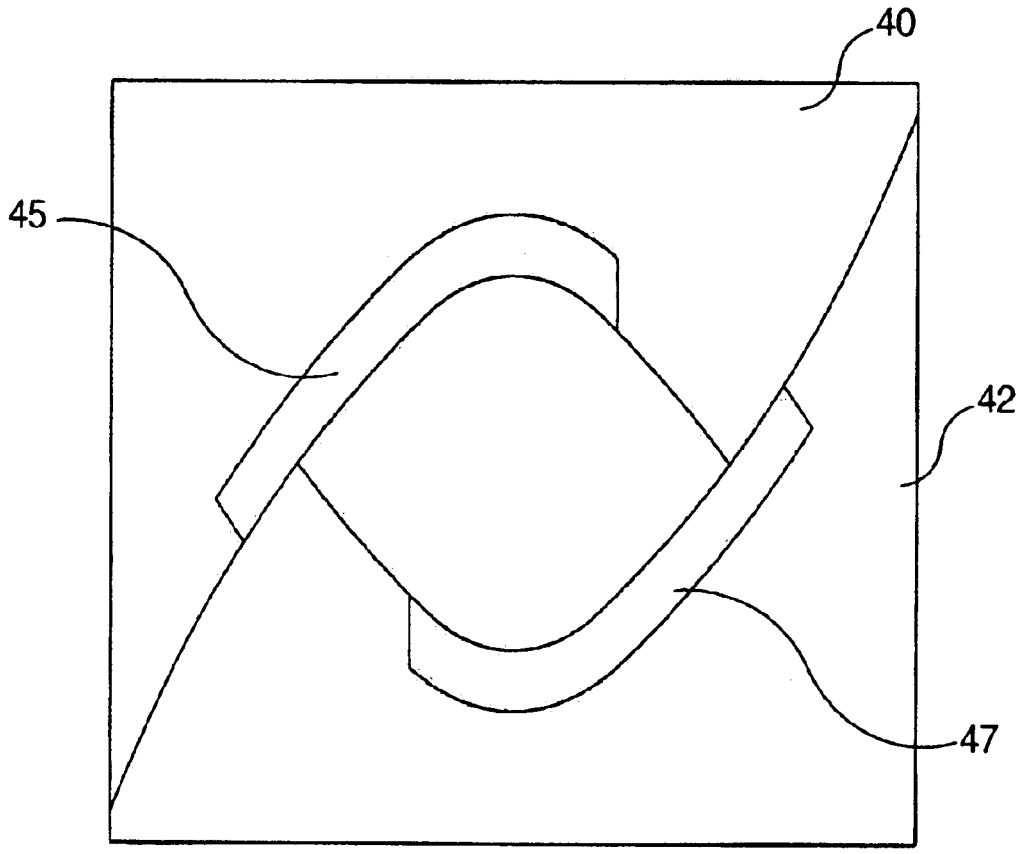
FIG. 9 illustrates a second embodiment of the guillotine mechanism.

The side edges of the guillotines may be rectilinear in shape as in the embodiment represented in FIGS. 8A and 8B. They can also be curved to fit even better the shape of the cable and to soften the coverage angle between the two parts of the diaphragm as shown in FIG. 9. In the two embodiments, the recess of each guillotine formed by the side edges features a rounded shoulder 45 or 47 which extends along the side edge of each guillotine and which is designed to provide better pressure distribution on the cable.

Owing to its geometric continuity, the interconnection device described above ensures homogenous transmission parameters between the cable and the connector interface block. It offers exceptional ease of use in the field. No special tools are required to be inserted in a compact cavity. This advantage is provided mainly by the closing lever of the dressing-block, which enables a large space to be opened before being folded down onto the conductors which are pre-positioned in the IDCs to ensure the electrical connection. Once the closing lever is pressed down, the assembly forms a cylinder adapted for insertion into a cylindrical cavity, thus having a geometry identical to that resulting from the interconnection of the male and female connectors.

We claim:

1. A connector designed to be interconnected to another connector of the same type so as to make the connection between two cables containing at least one twisted pair for the transmission of very high-frequency differential data signals, in which conductors of said pair are connected in a connection block by means of Insulation Displacement Contacts (IDC) to contact blades, adapted to ensure contact in an interface block with the corresponding contact blades of the other connector; said connector being characterized in that, when the connection is made, the geometry of the elements comprising said connection block is the same as the geometry of the elements comprising said interface block, said geometry being adapted so that the differential mode impedance between the conductors of each pair and the common mode impedance between said conductors and the shielding of said pair are respectively equal to the differential mode impedance between said contact blades and the common mode impedance between said contact blades and the shielding of the connector.

2. The connector according to claim 1, in which said IDCs as well as said contact blades are included in a dressing-block made of plastic material of cylindrical shape with a circular cross-section, said dressing-block being inserted into cavities of said connection block and said interface block, said cavities having conductive walls and also being of cylindrical shape with circular cross-section.

3. The connector according to claim 2, in which said cavities into which said dressing-block is inserted include a first cavity of first diameter located in said interface block and a second cavity of second diameter located in said connection block, both cavities having the same axis and being connected by a cavity having the shape of a truncated cone, wherein the second diameter is greater than the first diameter.

4. The connector according to claim 3, in which said connection block includes a rectangular cavity divided into four insulating sub-cavities by orthogonal conductive walls ensuring the transition from the shielding between the cable part where the shielding of the pairs are in contact with the part of the cable where the pairs are separated.

5. The connector according to claim 4, in which the shielding of each pair ends in said second cylindrical cavity such that said rectangular cavity has no influence on the electrical parameters of the pair.

6. The connector according to claim 5, in which said dressing-block includes a closing lever which enables, when it is open, said contact blades to be installed before being connected to the conductors of the associated pair and to place said conductors encased in their insulating jacket into said IDCs, the closure of said closing lever causing the penetration into said insulating jackets of sharp edges of said IDCs connected electrically to said contact blades and thus enabling the electrical connection between said conductors and said contact blades to be made.

7. The connector according to claim 6, in which the sharp edges of the IDCs form an integral part of said contact blades and are located at the end of said contact blades and transversally to them.

8. The connector according to claim 7, in which one of said contact blades is longer than the other so that said sharp parts located at the end of said blades are shifted to avoid contact between one another.

9. The connector according to claim 8, in which each of said contact blades includes a rectilinear part and a portion where contact takes place comprising a stiff side, a rounded bump, and an inclined plane so that when the connection is made between said connector and another connector of the same type, electrical connection between the contact blades of both connectors is made by the contact between the rounded bumps of both blades.

10. The connector according to claim 9, in which each of said contact blades is placed in a groove of the front part of said dressing-block located in said interface block, said groove featuring a recess located at the location of said portion where contact takes place so that said blade can occupy said recess during its deformation when the rounded bump of each of the contact blades passes behind the rounded bump of the other contact blade during the connection.

11. The connector according to claim 10, in which each of said contact blades has a constant thickness (T), and has an initial width (w) in its rectilinear part and a narrower second width (Wc) in the portion where contact is made with the corresponding portion of the contact blade of the other connector such that the common mode impedance is equal to:

$$Zc = \frac{60}{\sqrt{\varepsilon r}} \mathrm{Ln}\left(\frac{1.9B}{0.8W + T}\right)$$

where Ln stands for neperian logarithm and B=2H+T with H being the distance between the middle point of the base of the blade and the wall of the cavity, and is the same in the rectilinear part and in the portion where the contact takes place when Wc=W−1.25 T.

12. The connector according to claim 11, further including a clamping mechanism located forward of said connection block to grip the cable when the connection has been made, said mechanism comprising two guillotines sliding in side grooves of said connection block.

13. The connector according to claim 12, in which each guillotine includes racks on both of its edges adapted to block the guillotine when it slides in said grooves so as to adequately clamp the cable regardless of its diameter.

14. The connector according to claim 13, wherein the side edges of said guillotines form a 90° angle between them and a 45° angle in relation to the direction of movement of said guillotines during the clamping operation, such that the side edges of both guillotines form a diaphragm when they approach one another.

15. The connector according to claim 14, wherein each guillotine includes a shoulder located in the recess formed by said side edges and extending along a side edge of the guillotine so as to obtain better distribution of the pressure on the cable.

* * * * *